United States Patent [19]

Mitsuhashi et al.

[11] Patent Number: 4,954,693

[45] Date of Patent: Sep. 4, 1990

[54] VENTILATION REGULATED HOT AIR SUPPLIED CONSTANT TEMPERATURE OVEN

[75] Inventors: Kenhachi Mitsuhashi, Kanagawa; Shigeru Suga, Tokyo, both of Japan

[73] Assignees: Suga Test Instruments Co., Ltd.; The Yokohama Rubber Co., Ltd., both of Tokyo, Japan

[21] Appl. No.: 378,293

[22] Filed: Jul. 11, 1989

[51] Int. Cl.[5] ..... F24H 3/04

[52] U.S. Cl. ..... 219/400; 126/21 A; 219/496

[58] Field of Search ..... 219/390, 400, 388, 496; 126/21 A, 21 R

[56] References Cited

U.S. PATENT DOCUMENTS

| | | | |
|---|---|---|---|
| 2,098,295 | 11/1937 | Kettering | 219/400 |
| 2,443,373 | 6/1948 | Borsoff | 219/390 |
| 4,460,332 | 7/1984 | Lawler | 126/21 A |
| 4,512,327 | 4/1985 | Stiegler | 219/400 |
| 4,532,984 | 8/1985 | Smith | 219/400 |
| 4,700,685 | 10/1987 | Miller | 126/21 A |
| 4,782,214 | 11/1988 | Voegtlin | 219/400 |

*Primary Examiner*—Teresa J. Walberg
*Attorney, Agent, or Firm*—Wenderoth, Lind & Ponack

[57] ABSTRACT

A ventilation regulated hot air supplied constant temperature oven used for heat aging testing. Heated air of a predetermined temperature is supplied to a test oven body through an air supply port. Ventilation of the test oven is carried out through the air discharge port at a predetermined rate at predetermined time intervals. A discharge cylinder is provided at the discharge port, a blower is connected to the air supply port, a differential pressure detector is connected to the discharge cylinder and adapted to detect a differential pressure corresponding to the air flow rate on the basis of the data obtained in advance on the relation between a difference between the pressure at an outlet port of the blower and that at the discharge cylinder and the air flow rate, and a blower speed regulator is provided between the blower and the differential pressure detector and adapted to control the speed of the blower in accordance with an output level of a signal corresponding to a differential pressure measured by the differential pressure detector.

4 Claims, 1 Drawing Sheet

VENTILATION REGULATED HOT AIR SUPPLIED CONSTANT TEMPERATURE OVEN

BACKGROUND OF THE INVENTION

1. Field of the Invention:

This invention relates to a ventilation regulated hot air supplied constant temperature oven, and more particularly to the regulation of ventilation of a hot air supplied constant temperature oven used in a heat aging test for a sample of, for example, rubber and a plastic material.

2. Description of the Prior Art:

In general, in a heat aging test for a sample of rubber and a plastic material, the frequency in carrying out the ventilation of a test oven is controlled suitably, i.e., the number per hour of changing the air in the test oven during a test, the volume of which air corresponds to the capacity of the test oven, is set to not less than one. A difference in the frequency in carrying out the ventilation of the oven causes large variations of the results of the tests.

The conventional methods of measuring the ventilation frequency in such a constant temperature oven include a method of measuring a flow rate in an air discharge cylinder. However, since the durability of a flow meter with respect to temperature is low, the frequency in carrying out the ventilation of the oven is calculated generally by measuring the power consumption of a heater according to ASTM E 145 standards.

This method of calculating the frequency in carrying out the ventilation of the oven consists of the steps of determining an average power consumption, which is required to maintain a test temperature at the same level, of a heater with the air vents of the test oven closed so as to put the interior thereof in a non-ventilating state, determining an average power consumption, which is required to maintain the test temperature at a preset level, of the heater with the air vents of the test oven opened so as to put the interior thereof in a ventilating state, and then calculating the frequency in carrying out the ventilation, which can be used as an index of a flow rate of the air passing through the interior of the test oven while the air vents thereof are opened, on the basis of a difference between the power consumption determined in the two previous steps.

In this method, the temperature in the test oven is set to a level higher than the ambient temperature by 80°±2° C., and the temperature is increased so as to obtain thermal equilibrium, the power consumption being measured after the thermal equilibrium has been obtained.

Determining the frequency of ventilation in this manner requires a long period of time, and inaccurate results are obtained due to the variation of the temperature of the outside air, varialtion of power source voltage and variation of wind speed. Moreover, as a test proceeds, the sample in the oven generates a gas due to a chemical reaction caused by the high-temperature air, and the gas thus generated causes the discharge cylinder to be clogged, and the flow rate of the ventilating air to vary.

For example, during an operation for determining the frequency of ventilation, it takes at least 30 minutes to obtain thermal equilibrium after the attainment of a temperature higher than a prescribed ambient temperature by 80°±2° C., and not less than 30 minutes each time to determine the power consumption.

The determining of the power consumption is done three times with the test oven in a non-ventilating state, and three times with the test oven in a ventilating state, so that it is necessary to spend a long period of time for carrying out these measurement operations. If the power source voltage varies during the measurement of power consumption, it is difficult to obtain thermal equilibrium in the test oven. Especially, in the case where the frequency of ventilation is as low as not more than 10 times per hour, a difference between the power consumption determined with the test oven in a non-ventilating state and that determined with the test oven in a ventilating state is small. Therefore, more time is required and the calculated frequency of ventilation is inaccurate.

The variation of the ambient temperature causes heat radiated from the test oven to vary and the power consumption to differ. The matutinal, daytime and night-time temperatures in the test oven during operation differ usually to a great extent. When a temperature difference exceeds a prescribed level, it is necessary to interrupt the test and restart a measurement operation for determining the frequency of ventilation. If the test is continued without carrying out this operation, the calculation of the frequency of ventilation is made on the basis of the level of power comsumption which is determined initially with the test oven in a non-ventilating state in which the air vents thereof are closed. Therefore, the accuracy of the frequency of ventilation thus determined becomes low, and, especially, a lower level of frequency of ventilation makes the accuracy worse.

Even when a sample placed in the oven is tested under the conditions of a preset frequency of ventilation, the gas and plasticizer discharged from the sample into the discharge cylinder of the test oven are gradually condensed and deposited to cause the inner diameter of the cylinder to decrease. As a result, the flow rate of the air being changed which is discharged from the discharge cylinder varies with the lapse of time, and tends to increase the internal pressure of the test oven.

However, a conventional oven of this kind is not provided with a means for detecting an increase of the internal pressure thereof. Consequently, the frequency of ventilation varies gradually as the test progresses, and it exerts a great influence upon the results of the test before the person in charge of the test is aware of it.

SUMMARY OF THE INVENTION

An object of the present invention, which has been developed in view of these problems of a prior art ventilation regulated hot air supplied constant temperature oven, is to provide a ventilation regulated hot air supplied constant temperature oven capable of regulating the flow rate of the air, the temperature of which is regulated to a predetermined level, introduced into the test oven, directly and continuously without receiving any influence of the variation of the ambient temperature, by setting the levels of differential pressures on a differential pressure detector with reference to the data on the relation between a difference between the pressure at an outlet of a blower and that at the discharge cylinder and the flow rate of the air in the oven; capable of giving an alarm when the differential pressure varies due to the clogging of the discharge cylinder; capable of protecting a sample and providing reproducible results of test; and capable of omitting operations for determining the frequency of ventilation.

The present invention has been developed with a view to solving the previously-mentioned problems, and the gist of the present invention reside in a ventilation regulated hot air supplied constant temperature oven consisting of an oven body having an air supply port and an air discharge port to which a discharge cylinder is joined, a blower connected to the air supply port via an air supply passage, a differential pressure detector connected to the discharge cylinder and adapted to detect a differential pressure corresponding to an air flow rate on the basis of the data obtained in advance on the relation between a difference between the pressure at an outlet of the blower and that at the discharge cylinder and the air flow rate, a throttle regulating valve provided in an air supply passage between the air supply port and blower and adapted to be switched to a different degree of opening in accordance with the flow rate of the air from the blower, and a blower regulator provided between the blower and differential pressure detector and adapted to control the number of revolutions per minute of the blower in accordance with an output level of a signal corresponding to a differential pressure measured with the differential pressure detector, whereby the air flow rate is controlled in accordance with the level of the differential pressure without receiving the influence of the ambient temperature.

According to the present invention, the outside air to be supplied to the test oven through a filter, a heater and a throttle regulating valve is preheated throughout the year to a temperature higher than the ambient temperature so as to eliminate the influence of the ambient temperature, and it is fed to the test oven with the flow rate thereof controlled to a predetermined level by the blower and throttle regulating valve.

In order to control the air, which is preheated as mentioned above, and set the frequency of ventilation properly, differential pressures, which vary on the basis of the relation between air flow rates corresponding to the frequencies of ventilation and differential pressures are set on the differential pressure detector, and the number of revolutions per mintue of the blower is controlled by the blower regulator receiving a signal from the differential pressure detector.

The throttle regulating valve has its valve position switched in accordance with the frequency of ventilation. By means of this position switching operation in combination with an operation for controlling the number of revolutions per minute of the blower, the air flow rate is regulated to a required level.

When the difference between the pressure at the outlet port of the blower and that at the discharge cylinder varies, the blower regulator is operated in accordance with a signal from the differential pressure detector, so that the number of revolutions per minute of the blower is controlled properly to regulate the air flow rate to a required level.

When the discharge cylinder is clogged, so that the differential pressure is out of the range set on the differential pressure detector, this differential pressure is detected and an alarm is given out.

The above and other objects as well as advantageous features of the invention will become apparent from the following description of the preferred embodiment taken in conjunction with the accompanying drawings.

DESCRIPTION OF THE PREFERRED EMBODIMENT

An embodiment of the present invention will now be described with reference to the accompanying drawings.

Figure 1:
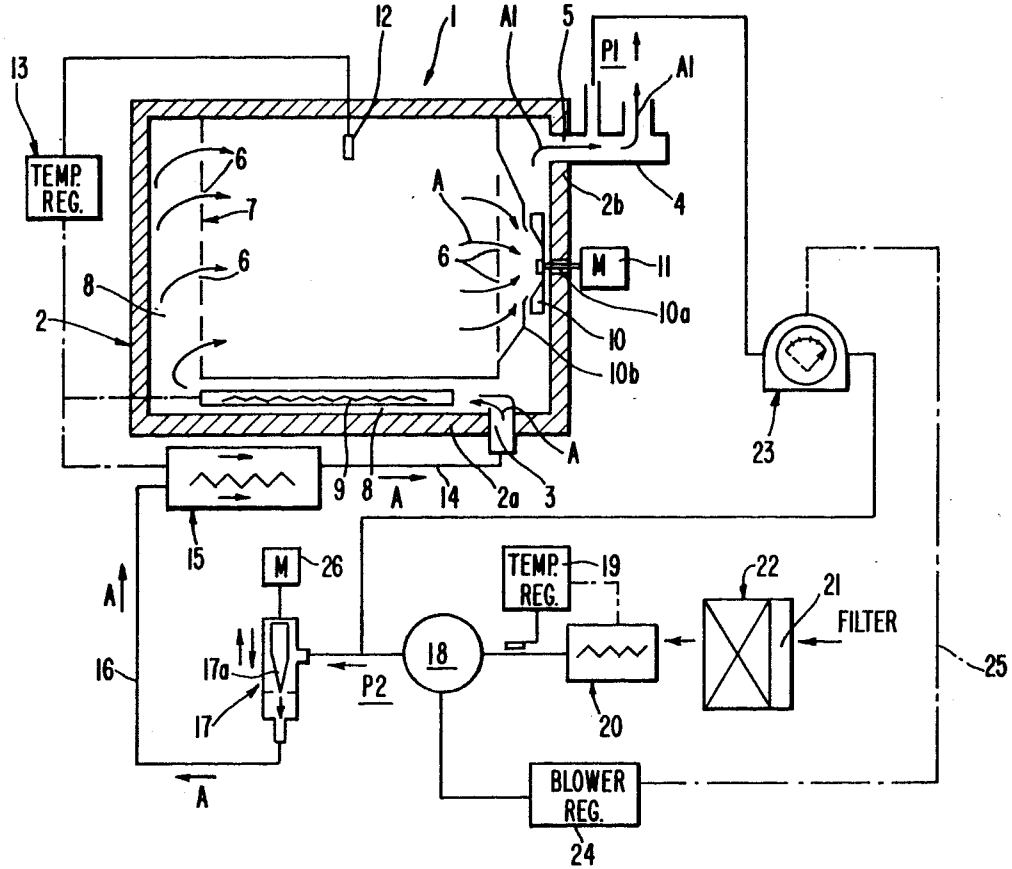
FIG. 1 is a schematic construction diagram of a ventilation regulated hot air supplied constant temperature oven embodying the present invention.

FIG. 1 is a schematic construction diagram of a ventilation regulated hot air supplied temperature oven embodying the present invention, in which a test oven body 1 consists of a hollow, cross-sectionally square box having heat-insulating walls 2, and is provided at its side portion with a door (not shown) adapted to be opened and closed for inserting and withdrawing a sample into and from the oven body 1. A lower wall **2*a* of the test oven body 1 is provided with a supply port 3 for the air A, and an upper wall 2*b* a discharge port 5 for the exhaust air A1, to which a discharge cylinder 4** is connected.

The test oven body 1 thus formed is provided therein with an air circulating passage 8 via a partition member 7 having a plurality of air vents 6, and a heater 9 is provided in the lower portion of the air circulating passage 8, an air circulating fan 10 being provided at the central portion of a side wall 2. The test oven body 1 is further provided at the upper protion of the interior thereof with a sample rotating frame (not shown) adapted to suspend therefrom a plurality of samples to be subjected to a heat aging test.

The air circulating fan 10 is opposed to the outer surface of the partition member 7, and a rotary shaft **10*a* of this fan 10 is set so that the axis of the shaft 10*a* is aligned with the centers of the opposed side walls 2, the fan 10 being rotated by a motor 11** to suck the air from the interior of a test chamber.

In the test oven body 1, the air circulating fan 10 is surrounded by a hood **10*b*** so that the air in the test chamber is sucked efficiently without causing the air to flow reversely.

The test chamber in the test oven body 1 is provided therein with a temperature detector 12 for measuring the temperature therein, and this temperature detector 12 is conencted to a temperature regulator 13 provided on the outer side of the test oven body 1.

An air supply passage 14 connected to the supply port 3 of the test oven body 1 is provided therein with a preheating means 15 consisting of a hot air box which is adapted to preheat the air A to a desired temperature, i.e. a temperature higher than that of the atmospheric air on the outer side of the test oven body 1 in accordance with a command from the temperature regulator 13 and supply the resultant air to the interior of the test chamber. A blower 18 is connected via a throttle regulating valve 17 to an air supply passage 16 joined to the preheating means 15.

The regulation of the temperature of the heater 9 in the test oven body is also carried out in accordance with a command from the temperature regulator 13.

A preheater 20 provided with a temperature regulator 19 is connected to the blower 18, and an air cleaner 22 provided with a dust removing filter 21 to the preheater 20.

A differential pressure detector 23 for detecting a difference between a discharge air pressure P1 and a pressure P2 at the outlet port of the blower 18 is connected to the discharge cylinder 4 which is joined to the discharge port 5 of the test oven body 1.

The differential pressures to be set on the differential pressure detector 23 are determined in advance on the basis of the relation between the flow rates corresponding to the frequencies of ventilation of the test oven body 1 and the differential pressures, and the differential pressures corresponding to the frequencies of ventilation are set on the differential pressure detector 23.

The differential pressure detector 23 has the function of outputting a signal to a blower's revolutions regulator 24, which is provided in a circuit 25 connecting the differential pressure detector 23 and blower 18 together, in accordance with a set differential pressure, and the function of detecting a difference between the pressure P2 at the outlet port of the blower 18 and the pressure P1 of the discharge air from the discharge cylinder, activating the blower's revolutions regulator 24 when an actual differential pressure varies with respect to the set differential pressure, to control the blower 18 to the number of revolutions per minute corresponding to a required air flow rate, and outputting an abnormality signal (for example, an alarm issuing signal) from an abnormal condition display means (not shown) when a gas and a plasticizer discharged from the sample into the discharge cylinder are deposited in a condensed state on the inner surface of the discharge cylinder to cause the inner diameter thereof to decrease, so that the detected differential pressure is out of the initially-set range.

In the blower's revolutions regulator 24 which is operated by a signal from the differential pressure detector 23, a frequency corresponding to a signal outputted in accordance with a differential pressure set or the differential pressure detector 23 is set, and the number of revolutions per minute of the blower 18 is controlled in accordance with this frequency.

Namely, when the discharge cylinder 4 is clogged to cause the differential pressure to decrease, the number of revolutions per minute of the blower is increased to heighten the air flow rate, whereby the flow rate of the air is regulated to a required level.

Figure 2:
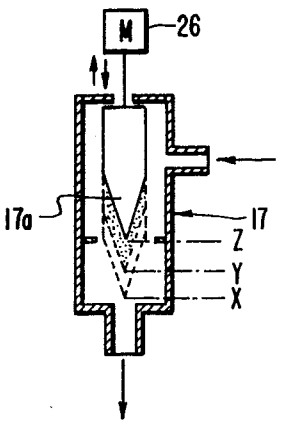
FIG. 2 is an enlarged view of a throttle regulating valve.

The throttle regulating valve 17 is constructed as shown in FIG. 2, in such a manner that a throttle valve member **17*a* is moved vertically by a driving motor 26** so as to enable the degree of opening of the valve to be set at several levels (for example, three levels of X, Y and Z).

The flow rate of the air supplied to the test oven body 1 is regulated by a combined control operations for suitably setting the number of revolutions per minute of the blower 18 and the position of the throttle regulating valve 17.

The position of the throttle valve member **17*a* in the throttle regulating valve 17 is switched in accordance with the frequency of ventilation, which is set to three steps of, for example, 1–10 times/hour, 11–100 times/hour and 101–200 times/hour, so as to regulate the air flow rate accurately, the resultant air being supplied to the test oven body 1**.

In order to shift the position of the valve member in the throttle regulating valve 17, a switch is shifted to a position corresponding to a required frequency of ventilation, and the throttle valve member **17*a*** is moved vertically and fixed properly.

The operation of this embodiment will now be described.

The air A, the flow rate of which is to be regulated to a predetermined level, supplied from the atmospheric air to the interior of the test oven body 1, is subjected to the removal of dust therefrom in the dust removing filter 21, and the removal of a contaminated gas therefrom in the air cleaning filter 22. The resultant air is controlled to a temperature, which is not influenced by the ambient temperature, for example, 40° C., in the preheater 20 provided with the temperature regulator 19, and it is subjected to the regulation of the flow rate thereof by the blower 18 and throttle valve 17, the air being then supplied to the preheating means 15, which consists of a hot air box, through the air supply passage 16.

The feed air A supplied to the preheating means 15 is preheated to a temperature equal to the internal temperature of the test oven body 1. The feed air A which has passed through the preheating means 15 is sent from the supply port 3 to the heater 9 in the air circulating passage 8 in the test oven body 1 and further preheated in accordance with a command from the temperature regulator 13. The air then flows from one partition member 7 into the test chamber through the air vents 6.

The temperature in the test chamber is detected by the temparature detector 12, which is provided in the test chamber, of the temperature regulator 13, and the heater 9 in the test oven body is controlled in accordance with a signal from the temperature detector 12 for the regulation of the temperature thereof, while the temperature of the air A passing through the preheating means 15 is regulated to the same level as in the test chamber.

The air A supplied to the interior of the test chamber is sucked by the rotation of the air circulating fan 10 and discharged via the discharge port 5 into the discharge cylinder 4.

The air in the test chamber is thus circulated in a temperature-regulated state, and the fresh outside air is supplied at a predetermined flow rate by the blower 18 into the test oven body 1 through the throttle regulating valve 17 and preheating means 15, the air in the test chamber being discharged from the discharge cylinder 4 at such a flow rate that corresponds to the quantity per hour of the ventilating air which varies with the frequency of ventilation.

The flow rate regulating blower 18 is controlled as mentioned above by regulating the number of revolutions per minute of the blower 18 in accordance with an operation of the blower regulator 24 which is adapted to be driven by a signal, which is representative of a deviation of an actual differential pressure from a differential pressure set on the differential pressure detector 23, from the same detector 23.

For example, in a test oven body of a capacity of 245 l, the relation between the frequency of ventilation, air flow rate and differential pressure is as shown in Table 1.

TABLE 1

| Frequency of ventilation times/Hr | Air flow rate l/Hr | Differential pressure $mmH_2O$ |
|---|---|---|
| 1 | 245 | 9 |
| 2 | 490 | 11 |
| 3 | 735 | 14 |
| 4 | 980 | 17 |
| 5 | 1,225 | 21 |

TABLE 1-continued

| Frequency of ventilation times/Hr | Air flow rate l/Hr | Differential pressure $mmH_2O$ |
|---|---|---|
| 6 | 1,470 | 26 |
| 7 | 1,715 | 31 |
| 8 | 1,960 | 36 |
| 9 | 2,205 | 42 |
| 10 | 2,450 | 50 |

The differential pressure detector 23 is adapted to detect a difference between the pressure $P_2$ at the outlet port of the blower and the $P_1$ in the discharge cylinder, and operate the blower's revolutions regulator 24 when the actual differential pressure deviates from the sent differential pressure, to control the air flow rate to a required level. When a gas or a plasticizer discharged from the sample into the discharge cylinder 4 is condensed and deposited on the inner surface thereof to cause the inner diameter of the discharge cylinder to decrease, so that the detected differential pressure is out of the initially set range, an abnormality signal is outputted. Consequently, an alarm signal is sent out, whereby the sample is protected. Accordingly, the accuracy and reliability of a test are improved greatly, so that the performance and efficiency of a test are improved markedly.

As mentioned previously, the regulation of the air flow rate is carried out by an operation for controlling the number of revolutions per minute of the blower 18 in combination with an operation for regulating the position of the valve member in the throttle regulating valve 17. The position of the valve member in the throttle regulating valve 17 is switched in accordance with the frequency of ventilation, which is set to, for example, three steps of 1–10 times/hour, 11–100 times/hour and 101–200 times/hour, to regulate the flow rate of the air more accurately, the resultant air being supplied to the test oven body 1.

As described above, the present invention provides a ventilation regulated hot air supplied constant temperature oven consisting of an oven body having an air supply port and an air discharge port to which a discharge cylinder is joined, a blower connected to the air supply port via an air supply passage, a differential pressure detector connected to the discharge cylinder and adapted to detect a differential pressure corresponding to the air flow rate on the basis of the data obtained in advance on the relation between a difference between the pressure at an outlet port of the blower and that at the discharge cylinder and the air flow rate, a throttle regulating valve provided in an air circulating passage between the air supply port and blower and adapted to be switched to a different degree of opening in accordance with the flow rate of the air from the blower, and a blower regulator provided between the blower and differential pressure detector and adapted to control the number of revolutions per minute of the blower in accordance with an output level of a signal corresponding to a differential pressure measured with the differential pressure detector. Therefore, a difference between the pressure at the outlet port of the blower and that in the discharge cylinder is detected constantly, and the flow rate of the air can be regulated to a predetermined level at all times without receiving any influence of the ambient temperature. Since the ventilation of the test chamber for maintaining the predetermined testing conditions can be carried out, the conditions for testing the sample can be kept constant. Moreover, since a differential pressure is detected constantly to detect the clogging of the discharge cylinder, the sample is protected, and the accuracy and reliability of a test are greatly improved. This enables the performance and efficiency of a test to be markedly improved.

For example, the following Table 2 shows the change in the rate of ventilation of the test oven before improvement in the embodiment and that of the rate of ventilation of the same test oven after improvement.

In the test oven before improvement, the rate of ventilation decreases gradually by as large as 38% from the initial level in six months due to the clogging of the discharge cylinder. Tests conducted in such condition were continued with the decrease of the rate of ventilation usually passing unnoticed, to cause the reliability of the results of the tests to lower. However, in the test oven after improvement, such a decrease of the rate of ventilation does not occur. Even when the rate of ventilation decreases to exceed a controllable range of levels, the fact can be sensed by the relative means provided. Accordingly, the tests can be carried out at an accurate rate of ventilation at all times by cleaning the discharge cylinder and re-checking the rate of ventilation.

TABLE 2

| | Change in rate of ventilation of test oven before improvement | Change in rate of ventilation of test oven after improvement |
|---|---|---|
| Time initially checked | 16.0 times/h | 16.0 times/h |
| 1 month later | 14.9 times/h | 16.1 times/h |
| 2 months later | 13.2 times/h | 16.0 times/h |
| 3 months later | 12.7 times/h | 15.9 times/h |
| 4 months later | 11.5 times/h | 15.9 times/h |
| 5 months later | 10.6 times/h | 16.0 times/h |
| 6 months later | 9.9 times/h | 16.1 times/h |

The present invention is not, of course, limited to the above embodiment; it may be modified in various ways within the scope of the appended claims.

What is claimed is:

1. A ventilation regulated hot air supplied constant temperature oven wherein heated air of a predetermined temperature is supplied to a test oven body provided with an air supply port and an air discharge port with the ventilation of said test oven carried out at a predetermined rate at predetermined time intervals, comprising an oven body having an air supply port and an air discharge port to which a discharge cylinder is joined, a blower connected to said air supply port via an air supply passage, a differential pressure detector connected to said discharge cylinder and adapted to detect a differential pressure corresponding to the air flow rate on the basis of the data obtained in advance on the relation between a difference between the pressure at an outlet port of said blower and that at said discharge cylinder and the air flow rate, and a blower's revolutions regulator provided between said blower and said differential pressure detector and adapted to control the number of revolutions per minute of said blower in accordance with an output level of a signal corresponding to a differential pressure measured with said differential pressure detector.

2. A ventilation regulated hot air supplied constant temperature oven according to claim 1, wherein said oven further includes a temperature regulator provided in said oven body via a temperature detector, and a preheater provided in the portion of said air supply passage which is between said air supply port of said test oven body and a throttle regulating valve, and adapted to preheat the feed air via said temperature regulator to a temperature higher than that of the air on the outer side of said test oven body.

3. A ventilation regulated hot air supplied constant temperature oven according to claim 1, wherein the portion of said air supply passage which is between said air supply port and said blower is provided with a throttle regulating valve adapted to be switched to a different degree of opening in accordance with the flow rate of the air from said blower.

4. A ventilation regulated hot air supplied constant temperature oven according to claim 1 or 2, wherein said differential pressure detector is provided with an abnormality display means adapted to inform an operator of the occurrence of abnormality when the differential pressure determined by said differential pressure detector is out of a range of preset levels.

* * * * *